US007714640B2

(12) United States Patent
Imtiaz

(10) Patent No.: US 7,714,640 B2
(45) Date of Patent: May 11, 2010

(54) NO-TRIM LOW-DROPOUT (LDO) AND SWITCH-MODE VOLTAGE REGULATOR CIRCUIT AND TECHNIQUE

(75) Inventor: S. M. Sohel Imtiaz, San Jose, CA (US)

(73) Assignee: Micrel, Inc., San Jose, CA (US)

( * ) Notice: Subject to any disclaimer, the term of this patent is extended or adjusted under 35 U.S.C. 154(b) by 100 days.

(21) Appl. No.: 12/032,565

(22) Filed: Feb. 15, 2008

(65) Prior Publication Data

US 2009/0206919 A1 Aug. 20, 2009

(51) Int. Cl.
*G05F 1/10* (2006.01)

(52) U.S. Cl. ..... 327/539

(58) Field of Classification Search ..... 323/313, 323/314; 327/512, 513, 538, 539, 543
See application file for complete search history.

(56) References Cited

U.S. PATENT DOCUMENTS

| | | | | |
|---|---|---|---|---|
| 4,638,239 | A * | 1/1987 | Hachimori | 323/281 |
| 7,038,440 | B2 * | 5/2006 | Cali' et al. | 323/313 |
| 7,193,454 | B1 * | 3/2007 | Marinca | 327/539 |
| 7,236,048 | B1 * | 6/2007 | Holloway et al. | 327/539 |
| 7,400,187 | B1 * | 7/2008 | Chen | 327/539 |
| 7,541,862 | B2 * | 6/2009 | Fujisawa et al. | 327/539 |

* cited by examiner

*Primary Examiner*—Jeffrey S Zweizig
(74) *Attorney, Agent, or Firm*—Sawyer Law Group P.C.

(57) ABSTRACT

An optimized output voltage circuit and technique obtainable without trimming is set forth. A voltage reference circuit and method devoid of trim resistors comprising a high gain amplifier, a plurality of bandgap resistors, and at least a plurality of bipolar devices interconnected across circuitry in a predetermined configuration having emitter areas greater than traditional emitter areas of traditional bipolar devices is set forth.

15 Claims, 6 Drawing Sheets

NO-TRIM LOW-DROPOUT (LDO) AND SWITCH-MODE VOLTAGE REGULATOR CIRCUIT AND TECHNIQUE

FIELD OF THE INVENTION

The present invention relates generally to voltage reference circuits and regulators, and more particularly, but not exclusively, to an optimized output voltage circuit and technique obtainable without trimming.

BACKGROUND OF THE INVENTION

Often, a voltage regulator is designed to incorporate a trimming scheme at the internal voltage reference circuit and/or at its output circuit. These traditional designs are sought for various applications including supplying a reference voltage for an analog-to-digital converter (ADC), providing a voltage reference circuit permitting a user to select a voltage internally generated by the circuit, or applying a different externally generated voltage through the integrated circuit pins. A trimming scheme is typically desired to trim the internally generated voltage to ensure that it is within the planned or designed voltage tolerance. Trimming may be necessary in these traditional designs as often typical variations arising during fabrication can result in certain of the fabricated integrated circuits (i.e., ICs, wafers, fabricated circuits, etc.) to have performance attributes which generate inaccurate voltage levels in operation. The resulting trimming may involve 2, 3, or more pins on the circuit to correct the voltage inaccuracy by receiving an external voltage source, providing an output for the internally generated voltage, and receiving trimming voltages used to trim the internally generated reference, for instance.

Various trimming techniques are known in the art such and include laser-trimming, digital potentiometers, using either resistors fabricated alongside active devices on an integrated-circuit die or trimmable discrete devices, and implementing a rejustor. Other trimming schemes may include flash memory based programmable logic approaches that require dedicated footprint or area of the integrated circuit. Further, programmable logic trimming techniques further require an accurately programmed logic to ensure trimming is limited to the necessary limits. However, common to each of these traditional techniques is added production burdens on resources of time, cost and/or pins of an integrated circuit, the latter of which is often at a premium in modern designs.

Unfortunately, each of these traditional techniques also typically requires extensive testing at the wafer level which accounts for a substantial portion of the product development cost of a wafer fabrication process.

FIG. 1 sets forth a simplified depiction of a bandgap circuit known as a Brokaw bandgap cell (without any start-up circuit) 100 which is typically implemented in low dropout (LDO) and switch-mode regulators. The Brokaw cell is a bandgap voltage reference circuit based on the addition of two voltages having equal and opposite temperature coefficients (TC). The first voltage is a base-emitter voltage of a forward biased bipolar transistor. In a typical Brokaw cell (i.e., bandgap cell or circuit), the first voltage has a negative TC of about −2.2 mV/C and is usually denoted as a Complementary to Absolute Temperature (CTAT) voltage. The second voltage, which is a Proportional to Absolute Temperature (PTAT) voltage, is formed by amplifying the voltage difference of two forward biased base-emitter junctions of bipolar transistors operating at different current densities. In general, bandgap circuits, and in particular the Brokaw bandgap cells, are well known in the art and understood that the bandgap circuit produces a voltage, $V_{BG}$, at 199, to a first order, which is temperature and supply independent and approximately equal to the silicon bandgap voltage of 1.2 Volts.

The cell of FIG. 1 uses MOS devices in high gain differential amplifiers (M9 and M10) (130 and 140, respectively), which contribute to higher mismatches and higher offsets for the circuit. These higher mismatches and higher offsets result in higher levels of inaccuracy in the bandgap circuit. When the bandgap reference is inaccurate, the output voltage of the regulators are also inaccurate, and thereby require trimming of the bandgap voltage and typically the output voltage (i.e., output voltage of circuit) as well.

The bandgap voltage accuracy in circuits similar to the traditional circuit of FIG. 1 is dependent upon the offset voltages of the bipolar devices (Q1 and Q2) (110 and 120, respectively) and metal-oxide-semiconductor field-effect (MOSFET) (M9 and M10) (130 and 140, respectively) devices. The predominant sources of offset error in the bipolar devices in these circuits include base width, base doping level, collector doping level and mismatches in effective emitter area. For metal-oxide semiconductor (MOS) type devices, the predominant sources of offset error are threshold voltage mismatch and the ratio of the effective channel width W over effective channel length L (W/L) for a given layout area (WL). Similarly, in yet other typical circuits involving modern BiCMOS process, the offsets in MOS devices are typically one order of magnitude higher than bipolar devices (where BiCMOS, also termed as BiMOS, refers to the integration of bipolar junction transistors and CMOS technology into a single device).

The bandgap circuit of FIG. 1 is therefore recognized to require resistor trimming in an attempt to improve bandgap voltage accuracy of the circuit. To improve upon the bandgap voltage inaccuracies arising with the traditional bandgap circuit, typically, resistor blocks or a plurality of resistors, reside at R1 and R2 (150 and 160, respectively). In combination with these resistors R1 and R2 (150, 160), often referred to as "trim resistors," is typically associated a plurality of diodes (not shown) in circuit connectivity. Each diode of the plurality is directly associated through circuit connectivity with a particular resistor in the resistor block (150, 160). In certain testing situations, one or more of these diodes, for traditional bandgap circuits, are shorted or "zapped" in a predetermined manner in order to thereby short an associated resistor in response to determination that the bandgap voltage of the circuit is inaccurate. When the associated resistor is shorted, the resulting bandgap voltage is reassessed with the shorted resistor and the bandgap voltage inaccuracy is lessened. This process is typically iteratively repeated for each circuit being assessed, often resulting in a plurality of resistors being shorted and the entire process per circuit becoming a lengthy, involved and expensive process.

FIG. 2 shows the variation of bandgap voltage ($V_{BG}$) over temperature 200 for a traditional bandgap cell, like the Brokaw cell of FIG. 1. From FIG. 2, the $V_{BG}$ varies 6 mV over the temperature range of −40° C. to 125° C. along 210. As is understood by those skilled in the art, additional bandgap voltage accuracies often result in traditional circuits from heat related effects on associated electronic circuitry.

As continues to be understood in the art, the necessity of trimming bandgap cells remains a costly and time-consuming effort. Accordingly, it is desired to eliminate the need for bandgap circuit trimming, reduce testing time, and lessen associated expenses, while improving the bandgap voltage accuracy of bandgap type produced circuits. It is also desired to mitigate heat effects in related circuitry so as to reduce bandgap voltage inaccuracies. The present invention, in accordance with its various implementations herein, addresses such needs.

SUMMARY OF THE INVENTION

In one implementation of the present invention, a method of improving a voltage circuit design to eliminate circuit trimming for a circuit producing a bandgap voltage ($V_{BG}$) to a first order, which approximates a predetermined designed bandgap voltage ($V_{BGDESIGN}$), comprising: removing resistors and diodes associated with trimming, repositioning each bandgap resistor to be horizontally positioned at a linear distance of at least 150 μm from a proximate power device, and, replacing MOS devices with bipolar devices in a predetermined configuration, is set forth.

In another implementation of the present invention, a voltage circuit devoid of trim resistors comprising a high gain amplifier, a plurality of bandgap resistors, and at least a plurality of bipolar devices interconnected across circuitry in a predetermined configuration capable to produce a bandgap voltage ($V_{BG}$), to a first order, approximating a predetermined designed bandgap voltage ($V_{BGDESIGN}$), wherein an emitter area of at least two or more of the bipolar devices is greater than a traditional emitter area of at least two traditional bipolar devices, is set forth.

In another implementation of the present invention, a voltage regulator devoid of trimming is set forth.

DETAILED DESCRIPTION

The present invention relates generally to voltage reference circuits and regulators, and more particularly, but not exclusively, to an optimized output voltage circuit and technique obtainable without trimming.

The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Figure 1:
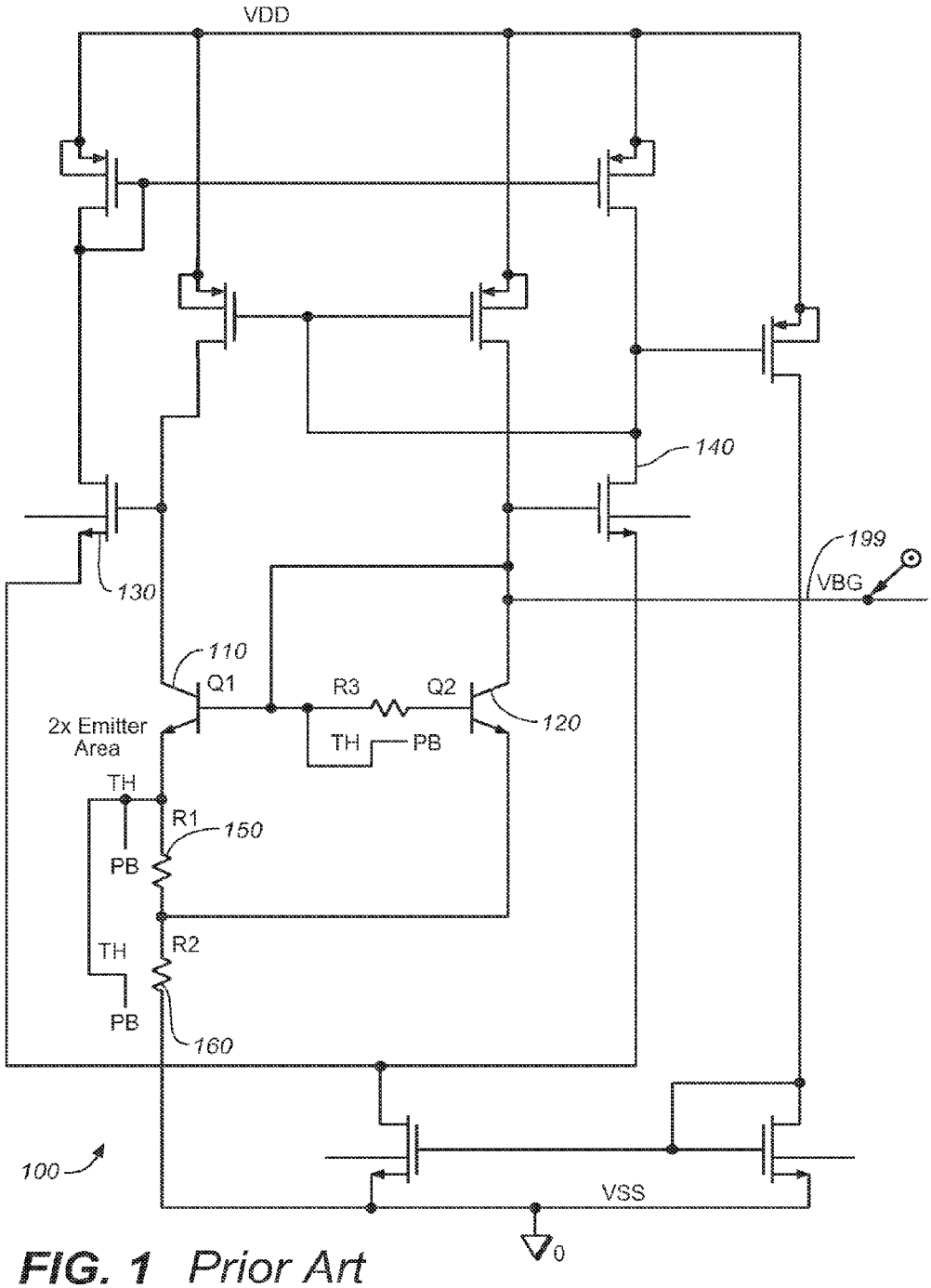
FIG. 1 Prior Art
FIG. 1 sets forth a simplified depiction of a bandgap circuit known as a Brokaw bandgap cell (without any start-up circuit) which is typically implemented in low dropout (LDO) and switch-mode regulators.
Figure 2:
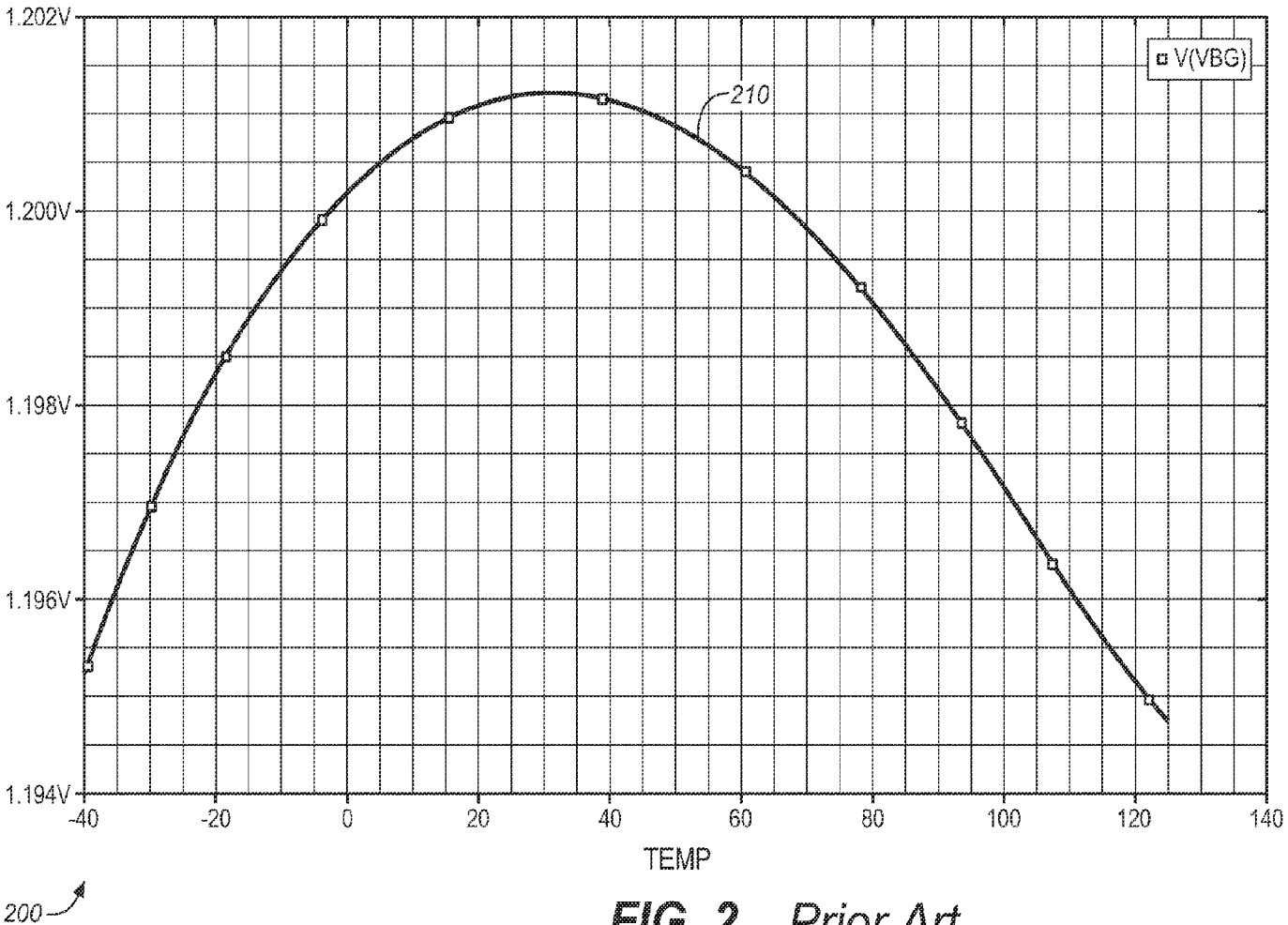
FIG. 2 Prior Art
FIG. 2 shows the variation of bandgap voltage ($V_{BG}$) over temperature for a bandgap cell, like the Brokaw cell of FIG. 1.
Figure 3:
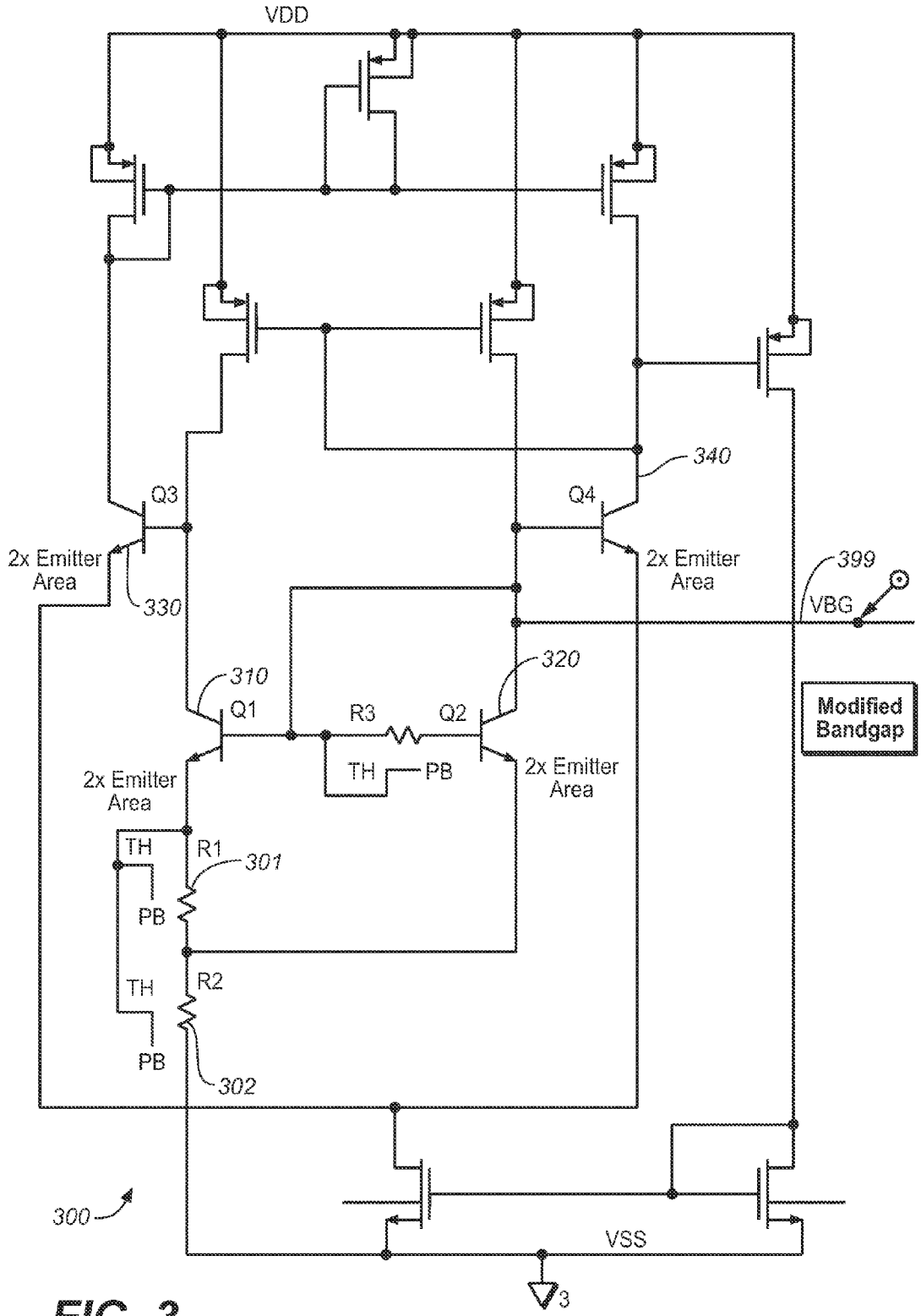
FIG. 3 depicts shows a circuit of the present invention, in one implementation, being of a modified bandgap circuit.

FIG. 3 depicts shows a circuit 300 of the present invention, in one implementation, being of a modified or improved bandgap circuit. From FIG. 3, the circuit comprises a high gain amplifier which uses bipolar devices instead of a MOS, as that of a traditional bandgap circuit. Preferably, the PTAT bandgap resistors, R1 and R2 (301 and 302 respectively), are also reduced in overall cumulative resistance as the R1 and R2 resistors are devoid of trim resistors and associated diodes in the present invention. With the use of the bipolar devices, the present invention, in one or more implementations, has a substantially improved offset and reduced inaccuracies.

From FIG. 3, in one implementation of the present invention, the emitter areas of bipolar devices Q1, Q2, Q3 and Q4 (310, 320, 330 and 340, respectively) are increased to twice (2×) that used in the traditional Q1 and Q2 devices of a traditional bandgap circuit design, though the present invention is not so limited as preferably the emitter areas are increased by multiples of at least 1.1 and up to 3. For the present invention, by increasing the emitter areas the offset due to emitter area mismatch in terms of percentages is substantially reduced. The $V_{BG}$ is set forth at 399.

Figure 4:
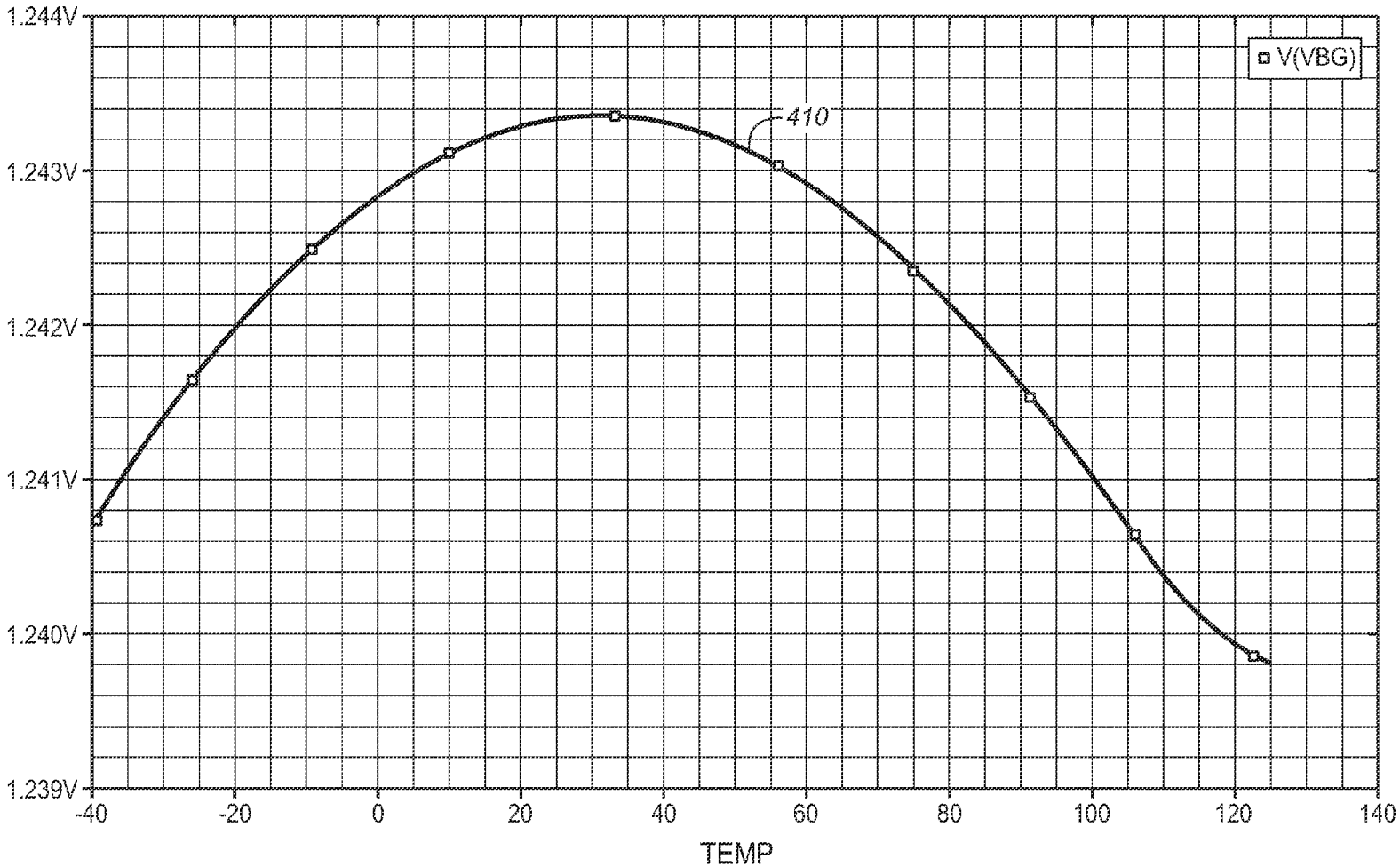
FIG. 4 shows the variation of bandgap voltage ($V_{BG}$) over temperature for the circuit of the present invention.

FIG. 4 shows the variation of bandgap voltage ($V_{BG}$) over temperature 400 for the circuit of the present invention in one implementation. From FIG. 4, it is readily determinable that the $V_{BG}$ of the present invention has limited variation. In one particular implementation, the $V_{BG}$ of the present invention was determined to vary only 3.5 mV over a temperature range of −40° C. to 125° C. along 410. As will be appreciated by those in the art, the present invention in various implementations, does not require trimming.

Figure 5:
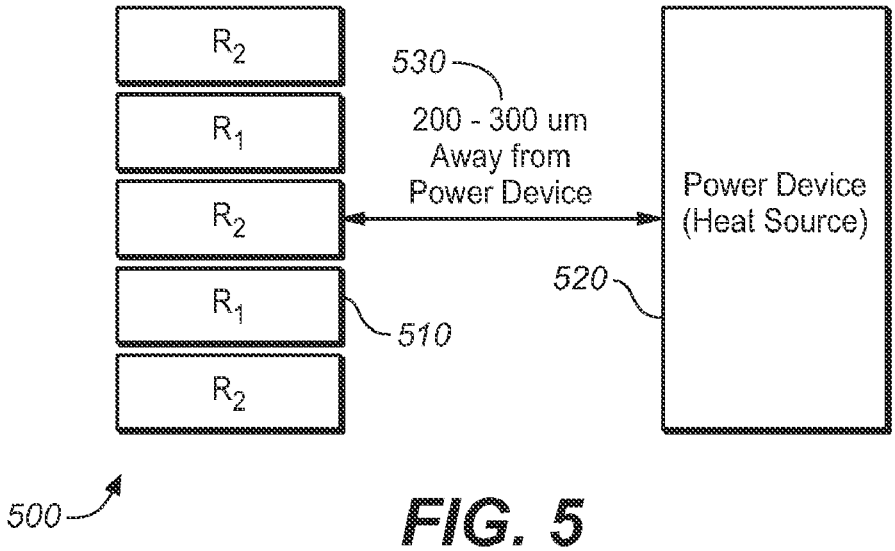
FIG. 5 depicts a representative layout of a preferred arrangement of PTAT bandgap resistors to further reduce or eliminate additional variances in one or more implementations of the present invention.

FIG. 5 depicts a representative layout of a preferred arrangement of PTAT bandgap resistors 510 (referenced by example as R1 and R2 in FIG. 3 (301, 302)) to further reduce or eliminate additional variances in one or more implementations of the present invention. In one or more implementations of the present invention, the placement and design of the PTAT arrangement sets forth preferred a proximate placement of the sensitive PTAT resistors in relation to a heat generating source 520 near or on the circuit (i.e., power devices) to reduce and mitigate localized heating effects. While, preferably a linear distance 530 of approximately 200 to 300 μm as between the PTAT resistors and the heat source has been determined to be an effective distance, the present invention is not so limited. It is envisioned that the present invention may also be applied in applications in which the distance between the PTAT resistors and the heat source is suitable in the range of 150 to 400 μm. Further, the present invention, in a preferred implementation, orients the PTAT resistors horizontally in relation to the heat source so that the resistances of R1 and R2, if affected by a proximate heat source, are increased similarly.

Figure 6:
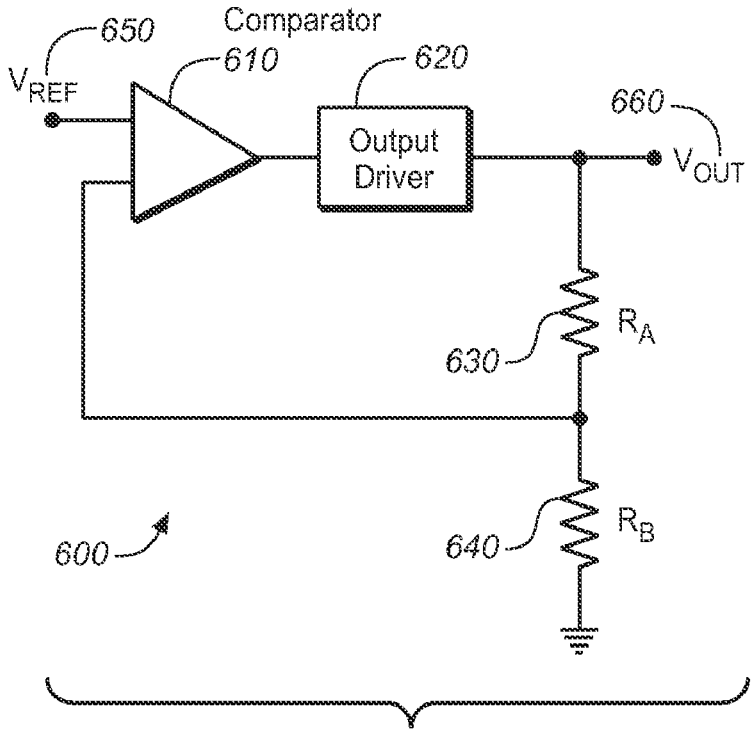
FIG. 6 depicts an output state of a voltage regulator comprising a comparator, output driver, and resistances $R_A$ and $R_B$, in a preferred implementation.

FIG. 6 depicts an output stage 600 of a voltage regulator comprising a comparator, output driver, and feedback resistances $R_A$ and $R_B$, in a preferred implementation.

Figure 7:
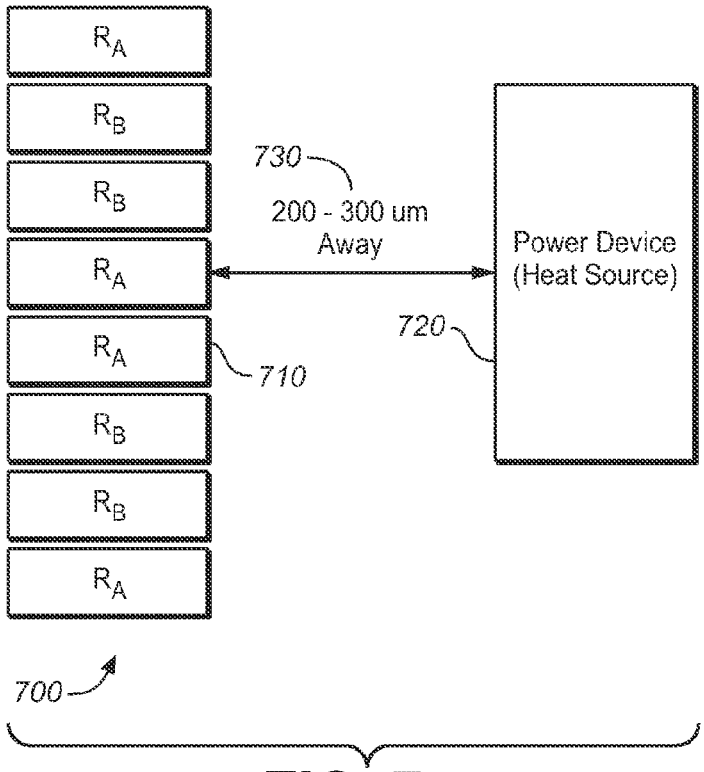
FIG. 7 depicts a preferred layout arrangement of feedback resistors arranged and configured to eliminate further variances and inaccuracies, in one or more implementations of the present invention; and, FIG. 8 depicts a flowchart of the method of the present invention for improving the bandgap voltage accuracy of a bandgap type circuit, in accordance with one implementation.

FIG. 7 depicts a preferred layout arrangement 700 of feedback resistors $R_A$ and $R_B$ at 710, arranged and configured to eliminate further variances and inaccuracies, in one or more implementations of the present invention. The sensitive feedback resistors 710 should be placed at least a linear distance (730) of approximately 200 μm from the heating sources (i.e., power device) 720 to avoid localized heating of the feedback resistors, although the present invention is not so limited. Further, the present invention, in a preferred implementation, orients the feedback resistors horizontally in relation to the heat source so that the resistances of $R_A$ and $R_B$, if affected by a proximate heat source, are increased similarly.

Figure 8:
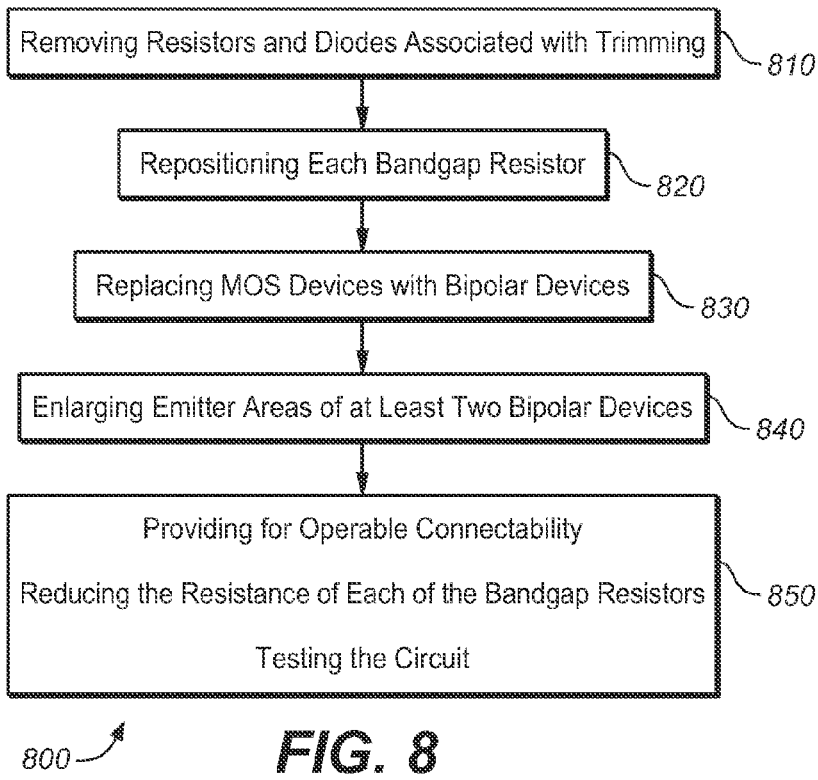

FIG. 8 depicts a flowchart of the method 800 of the present invention for improving the bandgap voltage accuracy of a bandgap type circuit, in accordance with one implementation. From FIG. 8, in one implementation, the present invention is a method of improving a voltage circuit design to eliminate circuit trimming for a circuit producing a bandgap voltage ($V_{BG}$) to a first order, which approximates a predetermined designed bandgap voltage ($V_{BGDESIGN}$). The present invention comprises removing resistors and diodes associated with trimming at 810 from a circuit or design; repositioning each bandgap resistor to be horizontally positioned at a linear distance of at least 150 μm from a proximate power device to reduce the effects of the heat source on an affected bandgap resistor at 820; and, replacing MOS devices with bipolar devices in a predetermined configuration at 830. Additionally, at 840, the present invention also comprises enlarging emitter areas of at least two bipolar devices comparatively to a traditional emitter area of a traditional bipolar device in one of a Brokaw cell, traditional bandgap circuit or an equivalent thereto. In a preferred implementation, four bipolar device emitter areas are enlarged as set forth in FIG. 3.

Optionally, the present invention, in a further implementation includes providing for operable connectability with an output stage circuit, reducing the resistance of one or more bandgap resistors, and testing the circuit, at 850.

The present invention is further advantageous over traditional methods as no trimming is required and inaccuracies of traditional circuits are overcome by the present invention. Time savings, costs savings, inventory and scrap savings are also readily anticipated by the present invention in an operational environment.

As used herein, it is envisioned that the present invention in one or more implementations may be hardware, software, firmware, or combinations thereof, in its composition and operation, and may therefore further comprise software, instructional code, other applications, and be a computer program product.

As used herein, the term "bandgap type circuit" when used, is intended to be a modified traditional band gap circuit, improved bandgap circuit, bandgap voltage reference circuit, low dropout regulator, voltage regulator, switch-mode voltage regulator, voltage referencing devices, thermal protection circuits, circuits based on the addition of two voltages having equal and opposite temperature coefficients, and associated designs, circuits, hardware, software, program code, scripts and electronic controllers for any of such.

As used herein, the terms comprises/comprising when used in the specification are intended to be and used to specify the presence of stated features, integers, steps or components, but do not otherwise preclude the presence or addition of one or more additional features, integers, steps, components or groups thereof.

As used herein, the term plurality when used in the specification and in the claims is intended to be and used to specify a quantity of two, three, four, five, six, or more of the described items associated with the term.

Various techniques and implementations of a bandgap circuit requiring no trimming have been described. Nevertheless, one of ordinary skill in the art will readily recognize that various modifications may be made to the implementations, and any variations would be within the spirit and scope of the present invention. For example, the above-described process flow is described with reference to a particular ordering of process actions. However, the ordering of many of the described process actions may be changed without affecting the scope or operation of the invention. Accordingly, many modifications may be made by one of ordinary skill in the art without departing from the spirit and scope of the following claims.

What is claimed is:

1. A bandgap circuit devoid of a trim resistors comprising a high gain amplifier, a plurality of bandgap resistors, and at least four bipolar devices interconnected across circuitry in a predetermined configuration capable to produce a bandgap voltage ($V_{BG}$), to a first order, approximating a predetermined designed bandgap voltage ($V_{BGDESIGN}$), wherein individually, the emitter area of at least three or more of the four bipolar devices is greater than a traditional emitter area of an equivalent traditional bipolar device by a factor within a range of approximately 1.75 to 2.25, wherein the predetermined designed bandgap voltage ($V_{BGDESIGN}$) approximates a voltage in the range of 1.15 to 1.35 volts and the bandgap voltage ($V_{BG}$) approximates a voltage of within 10% of the designed bandgap voltage ($V_{BGDESIGN}$), and wherein the plurality of bandgap resistors are configured to be horizontally positioned in relation to a heat source approximately situated beyond a linear distance of approximately 200 μm.

2. The circuit of claim 1, wherein the plurality of bandgap resistors are configured to be horizontally positioned in relation to a heat source proximately situated within a linear range of between approximately 200 and 500 μm.

3. The circuit of claim 2, wherein the plurality of bandgap resistors are configured to be positioned with respect to one another in an alternating pattern such that no like resistor of the plurality is situated next to an identical resistor type of the plurality.

4. The circuit of claim 3, wherein the heat source is power device.

5. The circuit of claim 1, further comprising an output stage of a voltage regulator having a comparator, output driver, and feedback resistors $R_A$ and $R_B$, wherein the feedback resistors are arranged and configured to be at least at a linear distance of approximately 175 μm from a proximate heating source.

6. The circuit of claim 5, wherein the feedback resistors are arranged and configured to be at least at a linear distance of approximately 200 μm from a proximate power device.

7. A voltage reference circuit devoid of trim resistors comprising a high gain amplifier, two or more bandgap resistors each being horizontally positioned at a linear distance of at least 200 μm from a proximate power device, and four or more bipolar devices interconnected across circuitry in a predetermined configuration capable to produce a bandgap voltage ($V_{BG}$), to a first order, approximating a predetermined designed bandgap voltage ($V_{BGDESIGN}$), wherein each emitter area of each of the bipolar devices is greater than a traditional emitter area of a traditional bipolar device in one of a Brokaw cell, traditional bandgap circuit or an equivalent thereto, whereby the circuit is operable connected with an output stage circuit having a comparator, output driver, and feedback resistors $R_A$ and $R_B$, wherein the feedback resistances are arranged and configured to be at a linear distance of at least 200 μm from a proximate heating source.

8. A method of improving a voltage reference circuit design to eliminate circuit trimming for a circuit producing a bandgap voltage ($V_{BG}$) to a first order, which approximates a predetermined designed bandgap voltage ($V_{BGDESIGN}$), comprising:

removing resistors and diodes associated with trimming, repositioning each bandgap resistor to be horizontally positioned at a linear distance of at least 200 μm from a proximate power device, and, replacing MOS devices with bipolar devices in a predetermined configuration.

9. The method of claim 8, further comprising enlarging emitter areas of at least two bipolar devices comparatively to a traditional emitter area of a traditional bipolar device in one of a Brokaw cell, traditional bandgap circuit or an equivalent thereto.

10. The method of claim 9, further comprising providing for operable connectability with an output stage circuit having a comparator, output driver, and feedback resistances $R_A$ and $R_B$, wherein the feedback resistances are arranged and configured to be at a linear distance of at least 200 μm from a proximate heating source.

11. The method of claim 10, further comprising reducing the resistance of each of the bandgap resistors.

12. The method of claim 11, wherein the circuit is one of a low dropout (LDO) regulator, a switch-mode regulator, or a voltage regulator circuit.

13. The method of claim 9, further comprising reducing at least a majority of resistance of all of the bandgap resistors by at least 5%.

14. The method of claim 13, wherein the circuit is one of a low dropout (LDO) regulator, a switch-mode regulator, or a voltage regulator circuit.

15. The method of claim 13, further comprising testing the circuit to produce a bandgap voltage ($V_{BG}$) to a first order within 10% of the predetermined designed bandgap voltage ($V_{BGDESIGN}$).

* * * * *